US010738992B1

(12) United States Patent
Hsu

(10) Patent No.: US 10,738,992 B1
(45) Date of Patent: Aug. 11, 2020

(54) MULTIFUNCTIONAL LAMP THAT IS ADAPTED TO FUNCTION AS ACOUSTICS LAMP AND GROUND INSERT LAMP

(71) Applicant: Dong Guan Jia Sheng Lighting Technology Co., Ltd., Dong-Guna, Guang-Dong (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/662,172

(22) Filed: Oct. 24, 2019

(51) Int. Cl.
*F21V 33/00* (2006.01)
*F21S 8/06* (2006.01)
*F21V 21/08* (2006.01)

(52) U.S. Cl.
CPC ..... *F21V 33/0056* (2013.01); *F21S 8/061* (2013.01); *F21V 21/0824* (2013.01)

(58) Field of Classification Search
CPC ... F21V 33/0056; F21V 21/0824; F21S 8/061
USPC ..... 362/86
See application file for complete search history.

(56) References Cited

U.S. PATENT DOCUMENTS 1,524,673 A * 2/1925 Rayder ..... H04R 1/345 181/141
1,587,096 A * 6/1926 Wheeler ..... H04R 1/028 455/350
1,665,826 A * 4/1928 Wheelan ..... H04R 1/345 181/141
1,727,419 A * 9/1929 Volf, Jr. ..... H04R 1/345 381/340
1,817,354 A * 8/1931 De Andia-Yrarrazaval ..... H04R 1/2842 181/148
2005/0024857 A1* 2/2005 Vishwamitra ..... A63J 17/00 362/152
2005/0185398 A1* 8/2005 Scannell, Jr. ..... H05B 47/19 362/227
2009/0073694 A1* 3/2009 Scannell, Jr. ..... A47G 7/06 362/253
2015/0300581 A1* 10/2015 Huang ..... F21V 33/0056 362/86
2017/0045208 A1* 2/2017 Lentine ..... F21V 15/01
2018/0087766 A1* 3/2018 Zhang ..... H05B 47/19
2018/0106472 A1* 4/2018 Wijaya ..... F21V 33/0056
2019/0041051 A1* 2/2019 Wijaya ..... F21V 23/004

* cited by examiner

*Primary Examiner* — Bryon T Gyllstrom
(74) *Attorney, Agent, or Firm* — Alan D. Kamrath; Karin L. Williams; Mayer & Williams PC

(57) ABSTRACT

An acoustics lamp includes a lamp body, a hanging device detachably mounted on the lamp body, a lighting device mounted in the lamp body, a sound device mounted in the lighting device, and a control device mounted in the lamp body. The control device drives and controls operation of the lighting device and the sound device. The acoustics lamp is mounted on a ground insert to construct a ground insert lamp.

9 Claims, 6 Drawing Sheets

MULTIFUNCTIONAL LAMP THAT IS ADAPTED TO FUNCTION AS ACOUSTICS LAMP AND GROUND INSERT LAMP

BACKGROUND OF THE INVENTION

1. Field of the Invention

The present invention relates to a lighting apparatus and, more particularly, to an acoustics lamp.

2. Description of the Related Art

A conventional lamp comprises a mounting seat, and a light source mounted on the mounting seat. Thus, the lamp provides an illuminating function. The conventional lamp is placed on the table only, is hung on the wall only, or secured on a fixed place only. However, the conventional lamp cannot be adapted to be placed on the table, hung on the wall, and secured on a fixed place simultaneously, thereby limiting the versatility of the conventional lamp. In addition, the conventional lamp only has a single function and cannot provide an audio function.

BRIEF SUMMARY OF THE INVENTION

An objective of the present invention is to provide a multifunctional lamp that is adapted to function as an acoustics lamp and a ground insert lamp.

Another objective of the present invention is to provide a multifunctional acoustics lamp available for multiple purposes.

In accordance with the present invention, there is provided an acoustics lamp comprising a lamp body, a hanging device detachably mounted on the lamp body, a lighting device mounted in the lamp body, a sound device mounted in the lighting device, and a control device mounted in the lamp body. The lamp body includes a base, an outer shell, a bottom plate, and a lampshade. The outer shell is provided with a plurality of sound outlet holes. The outer shell has an interior provided with a retaining flange. The retaining flange is located above the sound outlet holes. The base is mounted in the outer shell and located under the sound outlet holes. The lampshade is connected with the outer shell, and located above and limited by the retaining flange and the base. The lighting device is mounted in the outer shell and located above the retaining flange. The lighting device is located between the lampshade and the retaining flange and extends upward into the lampshade. The bottom plate covers an open bottom of the outer shell. A receiving space is defined between the bottom plate and the base, and the control device is mounted in the receiving space. A sound output space is defined between the sound device, a top face of the base, and the outer shell. The sound outlet holes is connected to the sound output space. The lighting device is electrically connected with the control device. The sound device is electrically connected with the control device. The control device drives and controls operation of the lighting device and the sound device.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
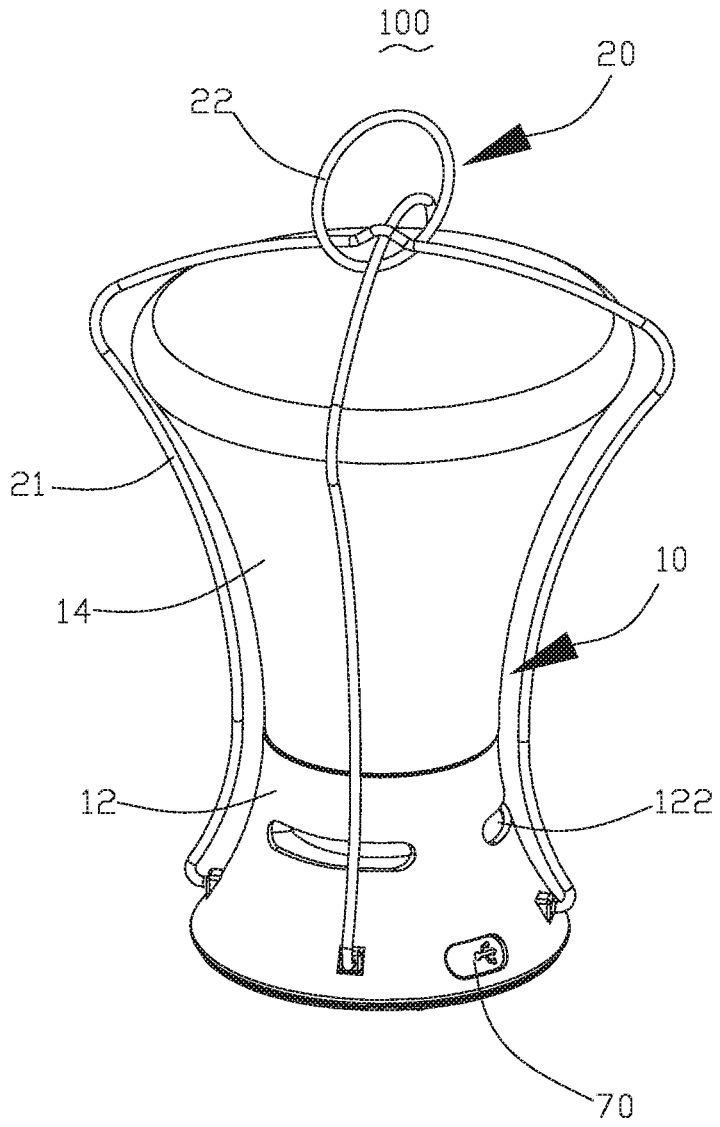
FIG. 1 is a perspective view of an acoustics lamp in accordance with the preferred embodiment of the present invention.
Figure 2:
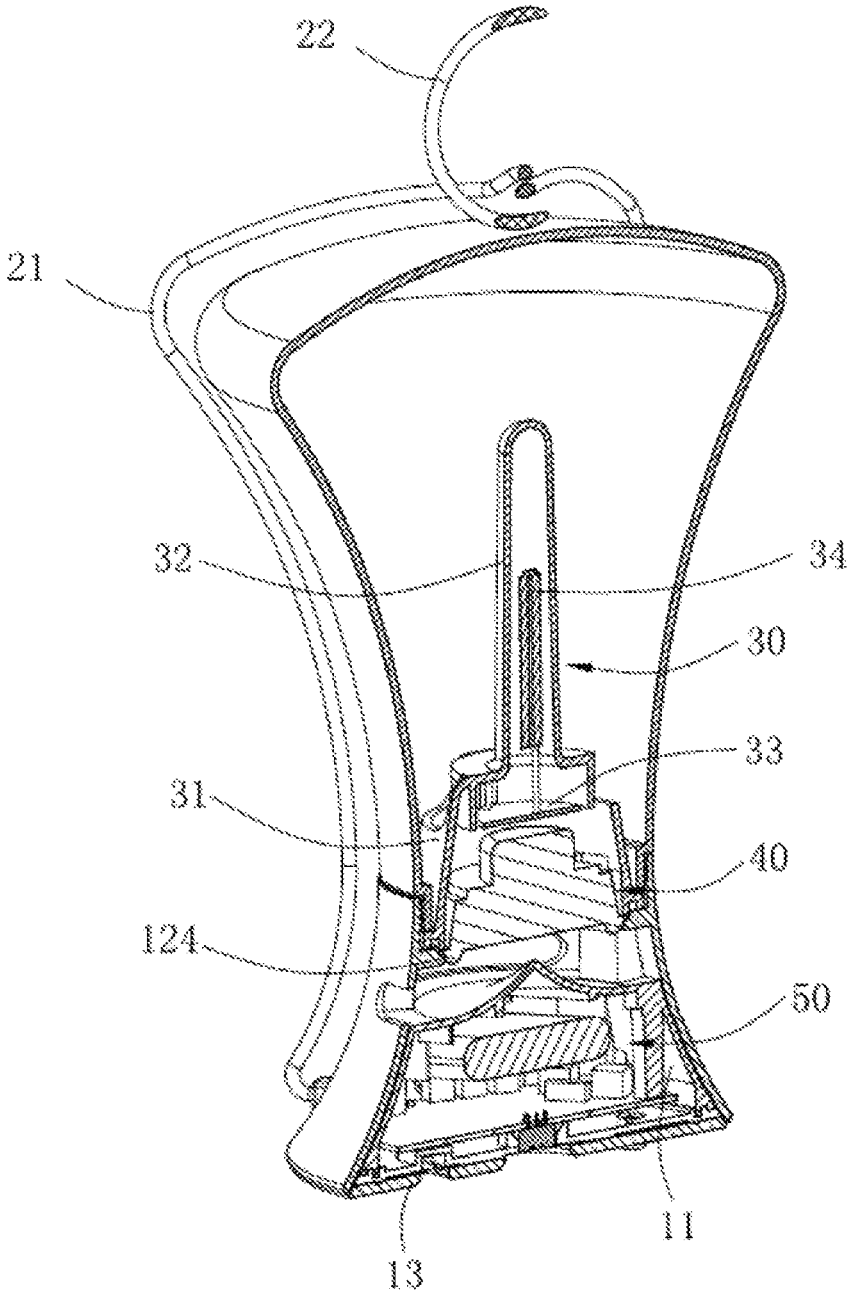
FIG. 2 is a perspective cross-sectional view of the acoustics lamp in accordance with the preferred embodiment of the present invention.
Figure 3:
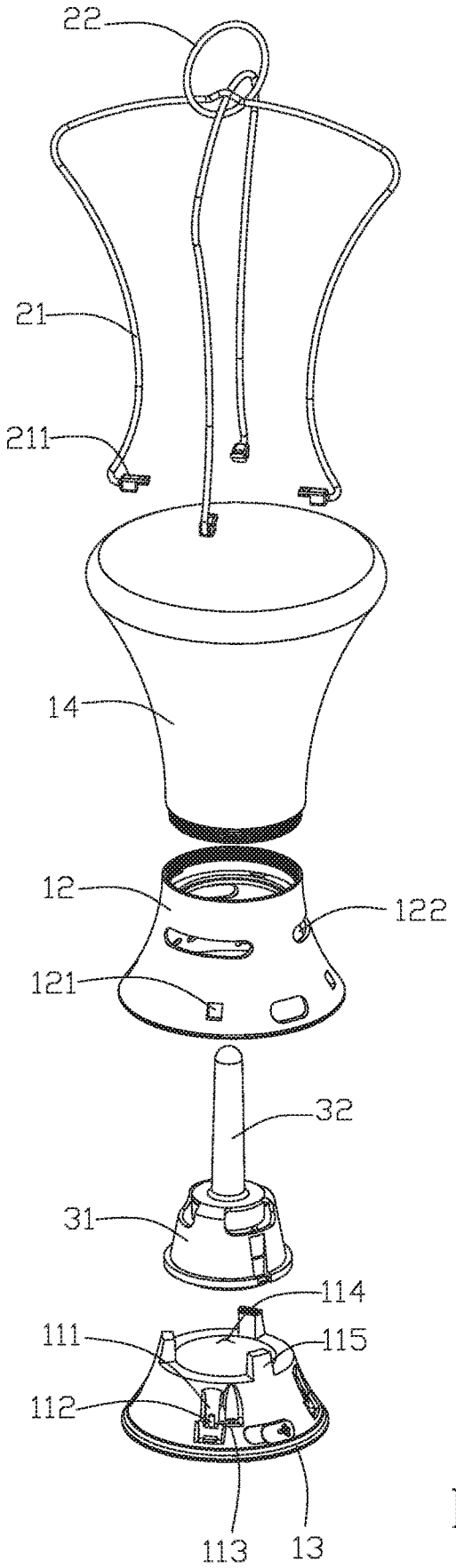
FIG. 3 is an exploded perspective view of the acoustics lamp in accordance with the preferred embodiment of the present invention.
Figure 4:
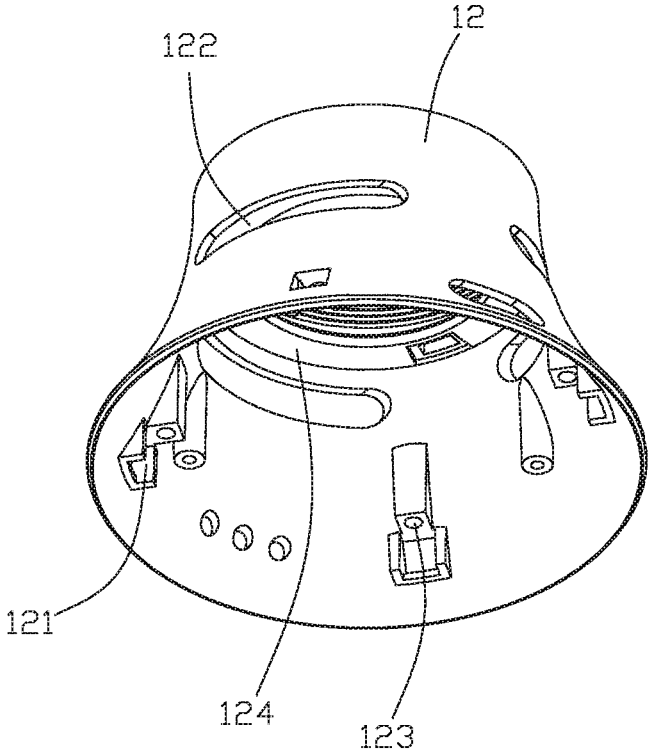
FIG. 4 is a perspective view of an outer shell of the acoustics lamp in accordance with the preferred embodiment of the present invention.

Referring to the drawings and initially to FIGS. 1-4, an acoustics lamp 100 in accordance with the preferred embodiment of the present invention comprises a lamp body 10, a hanging device 20 detachably mounted on the lamp body 10, a lighting device (or light source) 30 mounted in the lamp body 10, a sound device 40 mounted in the lighting device 30, and a control device 50 mounted in the lamp body 10.

The lamp body 10 has a determined shape and includes a base 11, an outer shell 12, a bottom plate 13, and a lampshade 14. The outer shell 12 is provided with a plurality of sound outlet holes 122. The outer shell 12 has an interior provided with a retaining flange 124 having an annular shape. The retaining flange 124 is located above the sound outlet holes 122. The base 11 is mounted in the outer shell 12 and located under the sound outlet holes 122. The lampshade 14 is connected with the outer shell 12 by screwing, and located above and limited by the retaining flange 124 and the base 11. The lighting device 30 is mounted in the outer shell 12 and located above the retaining flange 124. The lighting device 30 is located between the lampshade 14 and the retaining flange 124 and extends upward into the lampshade 14. The bottom plate 13 covers an open bottom of the outer shell 12. A receiving space is defined between the bottom plate 13 and the base 11, and the control device 50 is mounted in the receiving space. A sound output space is defined between the sound device 40, a top face of the base 11, and the outer shell 12. The sound outlet holes 122 is connected to the sound output space. The lighting device 30 is electrically connected with the control device 50. The sound device 40 is electrically connected with the control device 50 and emits sound outward through the sound output space and the sound outlet holes 122. The sound device 40 is arranged between the lighting device 30 and the base 11. The control device 50 drives and controls operation of the lighting device 30 and the sound device 40.

In the preferred embodiment of the present invention, the control device 50 includes a Bluetooth module connected to the lighting device 30 and the sound device 40. The Bluetooth module is connected to a cell phone signal. Thus, the Bluetooth module receives the cell phone signal, to regulate the lighting device 30 and the sound device 40.

In practice, the Bluetooth module is connected to the APP of a cell phone. Thus, the user controls operation of the lighting device 30 by the APP of the cell phone, to turn on/off the lighting device 30, and to regulate the brightness and color temperature of the lighting device 30. In addition, the audio signal of the APP of the cell phone is transmitted by the Bluetooth to the sound device 40, so as to play the audio signal and to control the volume. In use, the acoustics lamp 100 is placed on a table or plane. Alternatively, the acoustics lamp 100 is hung on a wall. Alternatively, the acoustics lamp 100 is directly held and carried by the user.

In the preferred embodiment of the present invention, the hanging device 20 includes a plurality of mounting arms 21 and a hanging ring 22 connected with the mounting arms 21. The mounting arms 21 extend through the lampshade 14 and the outer shell 12 into the base 11, and are locked in the base 11. The hanging ring 22 is arranged on a top of the lampshade 14.

In the preferred embodiment of the present invention, the base 11 is provided with a plurality of mounting posts 112. The outer shell 12 is provided with a plurality of passages 121 aligning with the mounting posts 112. Each of the mounting arms 21 has a lower end provided with a recessed locking portion 211 extending through one of the passages 121 into the outer shell 12 and locked onto one of the mounting posts 112 of the base 11.

In the preferred embodiment of the present invention, the base 11 has a horn shape and has a smaller upper end and a larger lower end. The base 11 has an outer face provided with a plurality of mounting recesses 111 and a plurality of mounting holes 113. The mounting recesses 111 align with the passages 121 of the outer shell 12, and the mounting posts 112 are mounted in the mounting recesses 111. The interior of the outer shell 12 is provided with a plurality of fitting holes 123. A plurality of fasteners extend through the bottom plate 13, the mounting holes 113 of the base 11, and the fitting holes 123 of the outer shell 12, such that the bottom plate 13, the base 11, and the outer shell 12 are combined together.

In the preferred embodiment of the present invention, the base 11 has a top provided with a voice guide face 114. The voice guide face 114 rises from a periphery toward a central position thereof, and has a pointed portion formed on the central position thereof. The sound device 40 has a speaker directed toward the voice guide face 114. Preferably, the sound output space is defined between the sound device 40, the voice guide face 114 of the base 11, and the outer shell 12.

In the preferred embodiment of the present invention, the retaining flange 124 is provided with a plurality of mounting holes, and the base 11 is provided with a plurality of guide columns 115 inserted into the mounting holes of the retaining flange 124. The guide columns 115 surround the voice guide face 114. The retaining flange 124 is spaced from the voice guide face 114.

In the preferred embodiment of the present invention, the lighting device 30 includes a holder 31, an inner lampshade 32, a circuit board 33, and a lamp tube 34. The inner lampshade 32 is formed integrally on the holder 31. The circuit board 33 and the lamp tube 34 are mounted in the holder 31. The lamp tube 34 is electrically connected with the circuit board 33 and extends upward into the inner lampshade 32. The sound device 40 is mounted in the holder 31. The holder 31 and the sound device 40 are located between the retaining flange 124 and the lampshade 14.

In the preferred embodiment of the present invention, the outer shell 12 is provided with a USB port 70 connected with the control device 50. The USB port 70 is used to charge a mobile device.

In the preferred embodiment of the present invention, the lower end of the lampshade 14 has an external thread, and the upper end of the outer shell 12 has an internal thread screwed onto the external thread of the lampshade 14.

Figure 5:
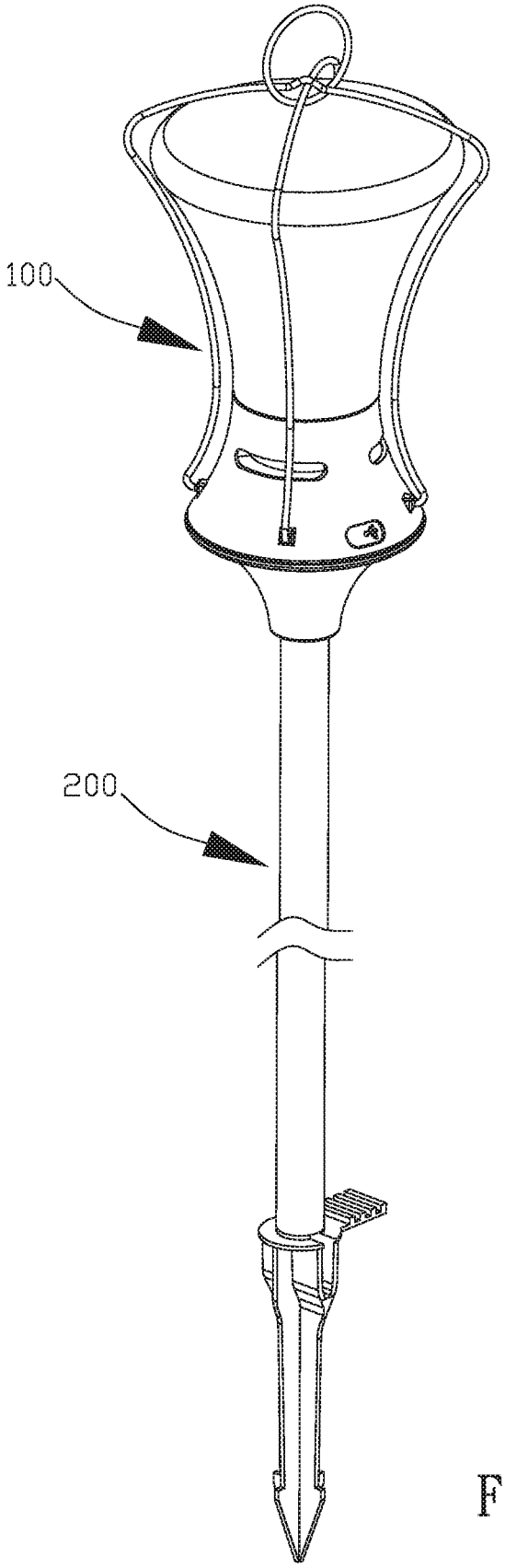
FIG. 5 is a perspective view of a combination of the acoustics lamp and a ground insert in accordance with the preferred embodiment of the present invention.
Figure 6:
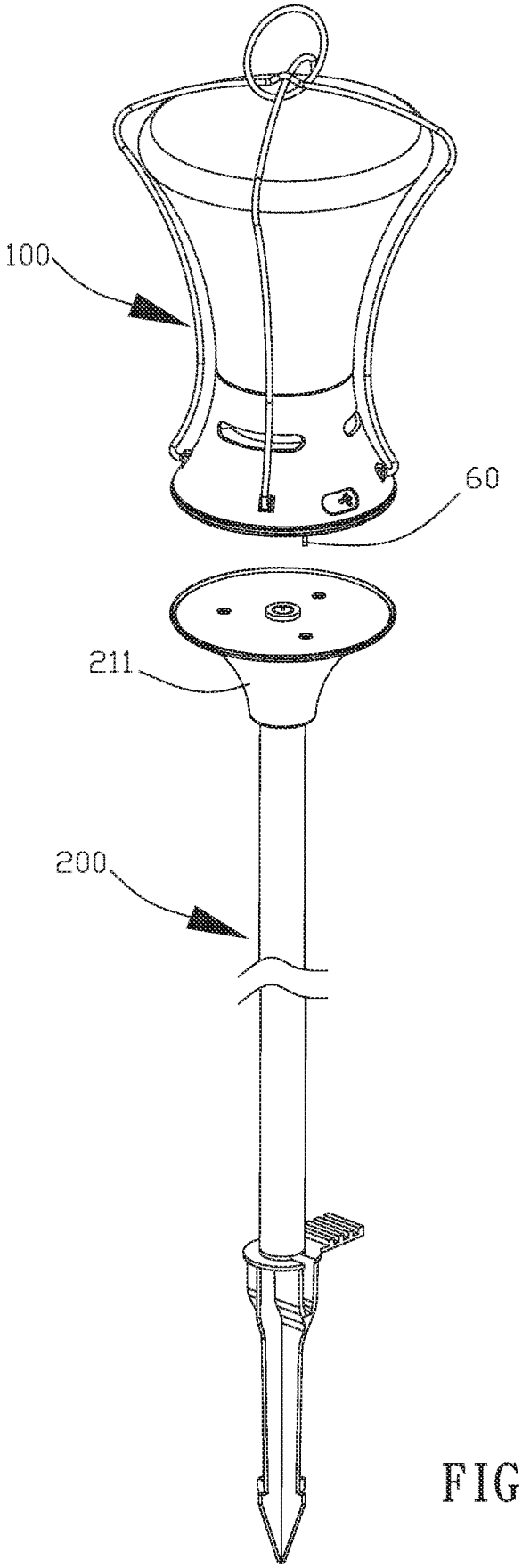
FIG. 6 is a partial exploded perspective view of the combination of the acoustics lamp and the ground insert as shown in FIG. 5.

Referring to FIGS. 5 and 6, the acoustics lamp 100 is mounted on a ground insert 200 to construct a ground insert lamp. The ground insert 200 has a top provided with a mounting portion 211. A charging device is mounted in the mounting portion 211 of the ground insert 200. The acoustics lamp 100 is mounted on a top of the mounting portion 211. The charging device charges the acoustics lamp 100. The mounting portion 211 of the ground insert 200 has a top provided with a plurality of positioning holes, and the acoustics lamp 100 has a bottom provided with a plurality of positioning stubs 60 inserted into the positioning holes of the ground insert 200.

Accordingly, the acoustics lamp 100 has multiple functions to enhance the versatility thereof. In addition, the acoustics lamp 100 is used indoors and outdoors. Further, the acoustics lamp 100 is placed on a determined place, is hung on the wall, is directly held and carried by the user, or is secured on the ground insert 200.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An acoustics lamp comprising:

a lamp body;

a hanging device detachably mounted on the lamp body;

a lighting device mounted in the lamp body;

a sound device mounted in the lighting device; and a control device mounted in the lamp body;

wherein:

the lamp body includes a base, an outer shell, a bottom plate, and a lampshade;

the outer shell is provided with a plurality of sound outlet holes;

the outer shell has an interior provided with a retaining flange;

the retaining flange is located above the sound outlet holes;

the base is mounted in the outer shell and located under the sound outlet holes;

the lampshade is connected with the outer shell, and located above and limited by the retaining flange and the base;

the lighting device is mounted in the outer shell and located above the retaining flange;

the lighting device is located between the lampshade and the retaining flange and extends upward into the lampshade;

the bottom plate covers an open bottom of the outer shell;

a receiving space is defined between the bottom plate and the base, and the control device is mounted in the receiving space;

a sound output space is defined between the sound device, a top face of the base, and the outer shell;

the sound outlet holes is connected to the sound output space;

the lighting device is electrically connected with the control device;

the sound device is electrically connected with the control device;

the control device drives and controls operation of the lighting device and the sound device;

the hanging device includes a plurality of mounting arms and a hanging ring connected with the mounting arms;

the mounting arms extend through the lampshade and the outer shell into the base, and are locked in the base; and the hanging ring is arranged on a top of the lampshade.

2. The acoustics lamp of claim 1, wherein the control device includes a Bluetooth module connected to the lighting device and the sound device.

3. The acoustics lamp of claim 1, wherein:

the base is provided with a plurality of mounting posts;

the outer shell is provided with a plurality of passages aligning with the mounting posts; and each of the mounting arms has a lower end provided with a recessed locking portion extending through one of the passages into the outer shell and locked onto one of the mounting posts of the base.

4. The acoustics lamp of claim 1, wherein the outer shell is provided with a USB port connected with the control device.

5. The acoustics lamp of claim 1, wherein:

the acoustics lamp is mounted on a ground insert to construct a ground insert lamp;

the ground insert has a top provided with a mounting portion;

a charging device is mounted in the mounting portion of the ground insert;

the acoustics lamp is mounted on a top of the mounting portion; and the charging device charges the acoustics lamp.

6. The acoustics lamp of claim 5, wherein the mounting portion of the ground insert has a top provided with a plurality of positioning holes, and the acoustics lamp has a bottom provided with a plurality of positioning stubs inserted into the positioning holes of the ground insert.

7. An acoustics lamp comprising:

a lamp body;

a hanging device detachably mounted on the lamp body;

a lighting device mounted in the lamp body;

a sound device mounted in the lighting device; and a control device mounted in the lamp body;

wherein:

the lamp body includes a base, an outer shell, a bottom plate, and a lampshade;

the outer shell is provided with a plurality of sound outlet holes;

the outer shell has an interior provided with a retaining flange;

the retaining flange is located above the sound outlet holes;

the base is mounted in the outer shell and located under the sound outlet holes;

the lampshade is connected with the outer shell, and located above and limited by the retaining flange and the base;

the lighting device is mounted in the outer shell and located above the retaining flange;

the lighting device is located between the lampshade and the retaining flange and extends upward into the lampshade;

the bottom plate covers an open bottom of the outer shell;

a receiving space is defined between the bottom plate and the base, and the control device is mounted in the receiving space;

a sound output space is defined between the sound device, a top face of the base, and the outer shell;

the sound outlet holes is connected to the sound output space;

the lighting device is electrically connected with the control device;

the sound device is electrically connected with the control device;

the control device drives and controls operation of the lighting device and the sound device;

the base has a top provided with a voice guide face; and the voice guide face rises from a periphery toward a central position thereof, and has a pointed portion formed on the central position thereof.

8. The acoustics lamp of claim 7, wherein:

the retaining flange is provided with a plurality of mounting holes;

the base is provided with a plurality of guide columns inserted into the mounting holes of the retaining flange;

the guide columns surround the voice guide face; and the retaining flange is spaced from the voice guide face.

9. An acoustics lamp comprising:

a lamp body;

a hanging device detachably mounted on the lamp body;

a lighting device mounted in the lamp body;

a sound device mounted in the lighting device; and a control device mounted in the lamp body;

wherein:

the lamp body includes a base, an outer shell, a bottom plate, and a lampshade;

the outer shell is provided with a plurality of sound outlet holes;

the outer shell has an interior provided with a retaining flange;

the retaining flange is located above the sound outlet holes;

the base is mounted in the outer shell and located under the sound outlet holes;

the lampshade is connected with the outer shell, and located above and limited by the retaining flange and the base;

the lighting device is mounted in the outer shell and located above the retaining flange;

the lighting device is located between the lampshade and the retaining flange and extends upward into the lampshade;

the bottom plate covers an open bottom of the outer shell;

a receiving space is defined between the bottom plate and the base, and the control device is mounted in the receiving space;

a sound output space is defined between the sound device, a top face of the base, and the outer shell;

the sound outlet holes is connected to the sound output space;

the lighting device is electrically connected with the control device;

the sound device is electrically connected with the control device;

the control device drives and controls operation of the lighting device and the sound device;

the lighting device includes a holder, an inner lampshade, a circuit board, and a lamp tube;

the inner lampshade is formed integrally on the holder;

the lamp tube is electrically connected with the circuit board and extends upward into the inner lampshade; and the sound device is mounted in the holder.

* * * * *